US008955180B2

(12) United States Patent
Pringle-Parker

(10) Patent No.: US 8,955,180 B2
(45) Date of Patent: Feb. 17, 2015

(54) STRETCHER WITH IMPROVED USE EFFICIENCY

(71) Applicant: Jason Pringle-Parker, Manassas Park, VA (US)

(72) Inventor: Jason Pringle-Parker, Manassas Park, VA (US)

(73) Assignees: Janice Pringle Parker, Charlottesville, VA (US); Sheldon H. Parker, Woodbridge, VA (US)

( * ) Notice: Subject to any disclaimer, the term of this patent is extended or adjusted under 35 U.S.C. 154(b) by 0 days.

(21) Appl. No.: 13/776,668

(22) Filed: Feb. 25, 2013

(65) Prior Publication Data

US 2013/0239332 A1 Sep. 19, 2013

Related U.S. Application Data

(60) Provisional application No. 61/603,282, filed on Feb. 25, 2012.

(51) Int. Cl.

| | |
|---|---|
| ***A61G 1/044*** | (2006.01) |
| ***A61G 1/013*** | (2006.01) |
| ***A61G 1/048*** | (2006.01) |

(52) U.S. Cl.

CPC ..... *A61G 1/044* (2013.01); *A61G 1/013* (2013.01); *A61G 1/048* (2013.01)

USPC ..... 5/628; 5/625

(58) Field of Classification Search

USPC ..... 5/625–628, 424

See application file for complete search history.

*Primary Examiner* — Peter M Cuomo
*Assistant Examiner* — Brittany Wilson
(74) *Attorney, Agent, or Firm* — Sheldon H. Parker

(57) ABSTRACT

A litter comprising two arm shafts. The first arm shaft being the lock receiving frame arm and having a first locking member and a locking shaft having a second locking member. The second and first members interact to releasably retain the two arm shaft adjacent one another. Strap retaining means, each interacting with a strap, are place separately along the first arm shaft. The second arm shaft is a strap receiving arm with at least one ratchet dimensioned to receive a strap. A one torque limiter prevents each strap from being tightened beyond a preset tension point. A ratchet shaft, with a handle, is within the second arm shaft and in rotatable connection with each ratchet. Each arm shaft has a lockable handle rotatable around each end, able to rotate to serve as handles or legs.

7 Claims, 10 Drawing Sheets

STRETCHER WITH IMPROVED USE EFFICIENCY

FIELD OF INVENTION

This invention relates to a medical stretcher with improved loading/securing mechanism, and improved dragging mechanism.

BACKGROUND OF THE INVENTION

A stretcher is a medical device used to carry casualties or an incapacitated person from one place to another. Various embodiments of stretchers are known and used in the art.

The evacuation of injured or incapacitated persons in rural, underdeveloped, disaster, and war affected terrains, where commercial medical stretchers are incompatible or useless has been a unresolved problem. Currently available stretchers for rural, underdeveloped, disaster and war affected terrains, including those currently used by the U.S. military, require two persons to effectuate an evacuation. Furthermore, these stretchers are excessively bulky, heavy, and difficult to operate under normal extreme conditions presented in disaster and war affected terrains.

In civilian use, many people enjoy participating in outdoor activities such as running, hiking, mountain climbing and the like, and one of the drawbacks of many of these activities is the danger of serious injury or illness in an area that is difficult for emergency personnel to reach. When an injury or serious illness does occur in a remote or hard to reach location, it can be very difficult to safely transport the injured or incapacitated person from the remote location to a medical facility.

During combat, medical treatment facilities are typically located in a secure area separate from the battlefield. To receive medical care, the injured and wounded must be transported from the battlefield using conventional military issued litters. The survival and recovery of these individuals significantly depends upon extraction time; therefore it is desirable to design a litter that can be easily carried and quickly assembled under combat conditions to facilitate the extraction process and enable patients to more quickly obtain medical treatment.

Current U.S. military issued litter systems are heavy, bulky, often difficult to assemble and can be a substantial liability to the extraction process. These litter systems typically remain on transport vehicles during field exercises because of their prohibitive large weight and size. Therefore, litters are often not readily available to the military unit while on combat missions.

Although lighter weight structures have been designed the remaining issues to be resolved. The disclosed stretcher provides a number of advantages over prior art stretchers, with the primary improvements being in the strapping system and adjustable legs.

DETAILED DESCRIPTION

Figure 1:
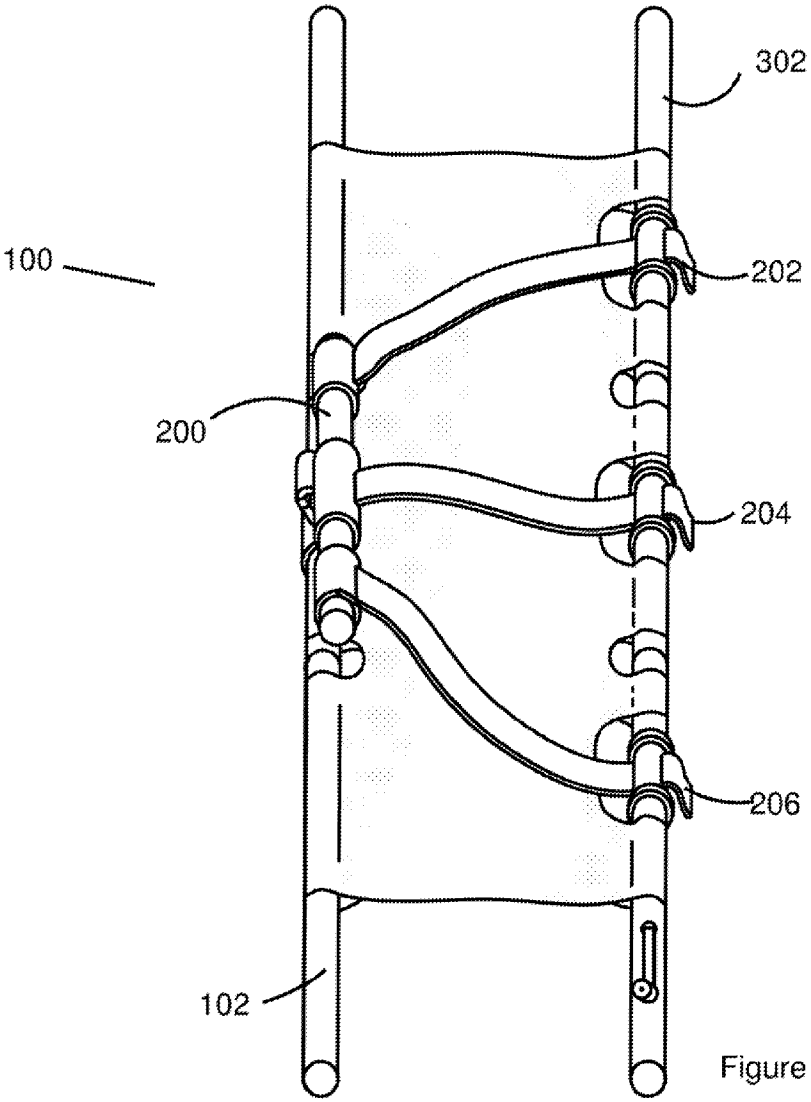
FIG. 1 is a top isometric view of the entire stretcher using the lock, strap spreader, and ratchet system.

FIG. 1 shows the disclosed stretcher 100 in a lock and closed position. The body straps 202, 204, and 206 have been pulled from the lock arm 200, adjacent to frame arm 102, to extend across the stretcher 100 to be secured at their appropriate places on the second frame arm 302.

Figure 2:
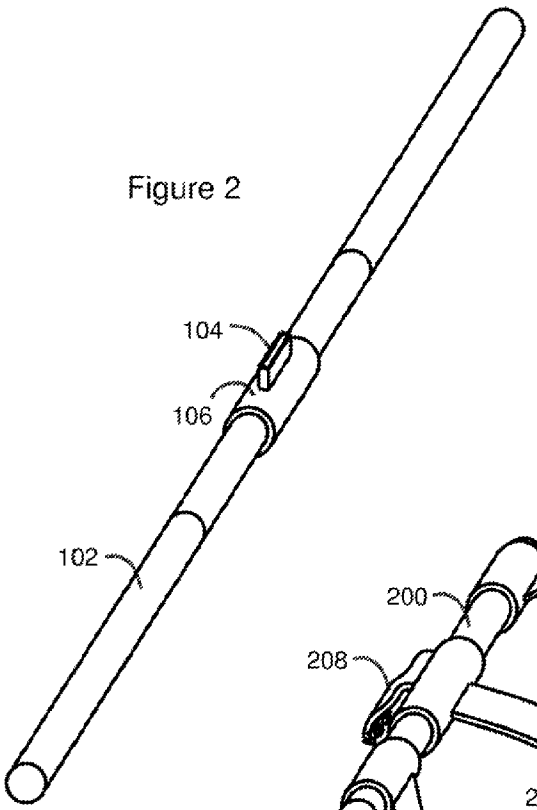
FIG. 2 is an isometric view of a frame arm with a lock.

As illustrated in FIG. 2, the stretcher has a lock-receiving frame arm 102, which has the receiving end of a lock 104. The frame arms 102, 200 and 302 are preferably metal, but can also be any material of sufficient strength and rigidity such as composite, plastic or carbon fiber. The receiving end of the lock 104 can be built directly into the frame arm 102 for increased strength, but it is preferred for the receiving end of the lock 104 to be attached to a sleeve 106 that wraps the frame arm 102. This is similar to existing stretchers. The sleeve 106 can be of any material of sufficient strength, including metal, plastics and fabrics such as nylon or polyester. Because the stretcher uses a single-point lock rather than multiple locking points like traditional stretchers, the lock 104 will be taking more weight, and will need to be of sufficient build to support all of the occupant's weight without failing. A three-prong plastic snap lock and a car seatbelt lock are two examples of sturdy simple locks, although almost any style of lock can be used as long as it is quick to secure.

Figure 3:
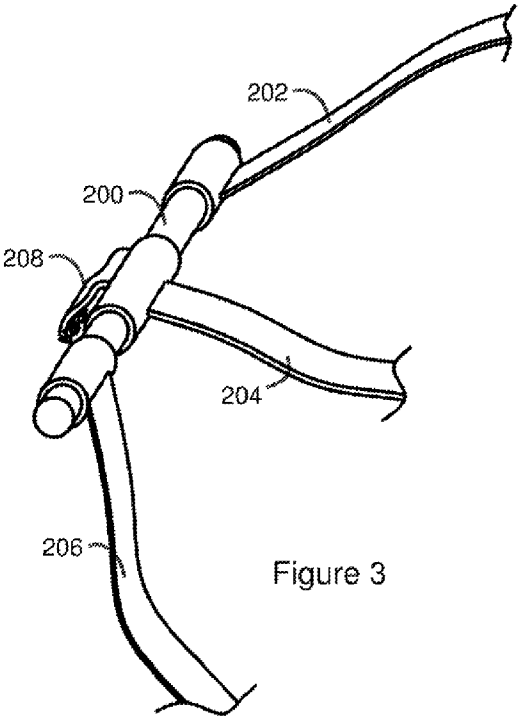
FIG. 3 is an isometric view of the lock, straps, and strap spreader.

The lock arm 200, as shown in FIG. 3, is designed to space the body straps 202, 204, 206 since there is only a single locking point. By spreading the straps over the length of the body, the stretcher occupant is better secured. The unit is not limited to three straps, and can use one or more straps. The lock arm 200 can be metal for increased rigidity, alternatively other materials such as plastic, composits or heavy fabric such as multiple layers of stiff nylon can be used to provide a lighter lock arm 202 while retaining durability and rigidity. The lock arm 200 has a lock 208 that connects to the lock 104 on the lock-receiving frame arm 102.

Figure 4:
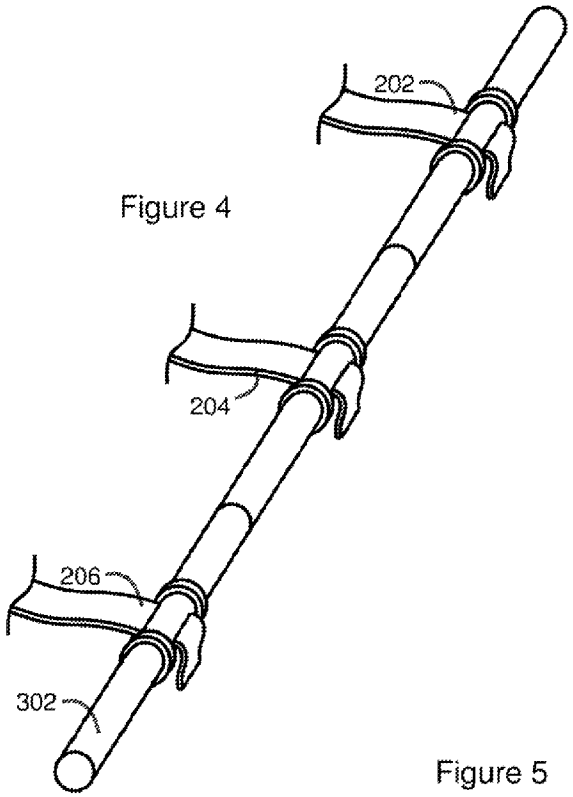
FIG. 4 is an isometric view of frame arm with strap ratchets.
Figure 5:
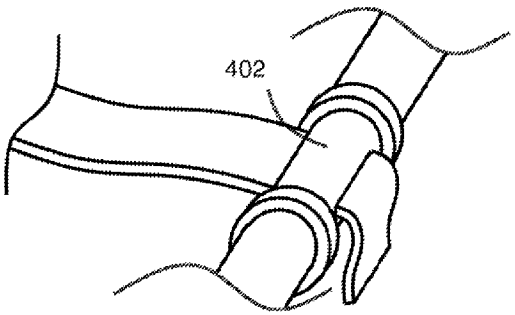
FIG. 5 is an isometric view of a strap ratchet.

The second frame arm is the strap-receiving frame arm 302 shown in FIG. 4. The strap-receiving frame arm 302 is connected to the lock arm 200 by the body straps 202, 204, 206. The straps 202, 204, 206 connect to the strap-receiving frame arm 302 at ratchets 402, FIG. 5, built into the strap-receiving frame arm 302. The ratchet system is similar to standard ratchet tie down straps used with vehicles. A standard homeuse ratchet strap is rated for several thousand pounds, and will be more than adequate to secure a person, even one in full military gear. An important feature in the ratcheting system as used here is the use of a torque limiter. While less common than a standard ratchet, they are freely available on the market. Examples include the Ancra Torque Limiting Ratchet.

A torque limiter allows the strap tension to be set, and no matter how much ratcheting is done, the strap will not tighten beyond that preset tension point. This is important for two reasons. The first is that when two or more straps are used on the stretcher, due to the shape of the body the two straps will not be in the secured position at the same time. That is to say that the two straps will need to be different lengths, so a standard ratchet will not work as when one strap is secure, the others will be too tight or too loose. With a torque limiter on each ratchet, if there are three straps, each strap will stop tightening at the appropriate point, allowing the remaining straps to continue tightening until all of the straps are secure. The second reason this is important is that it removes all human error for tightening the straps. A human can tighten the straps too much, further injuring the occupant, or too little leaving them poorly secured. By having a torque limiter ratchet, each strap will be perfectly secured every time.

Figure 6:
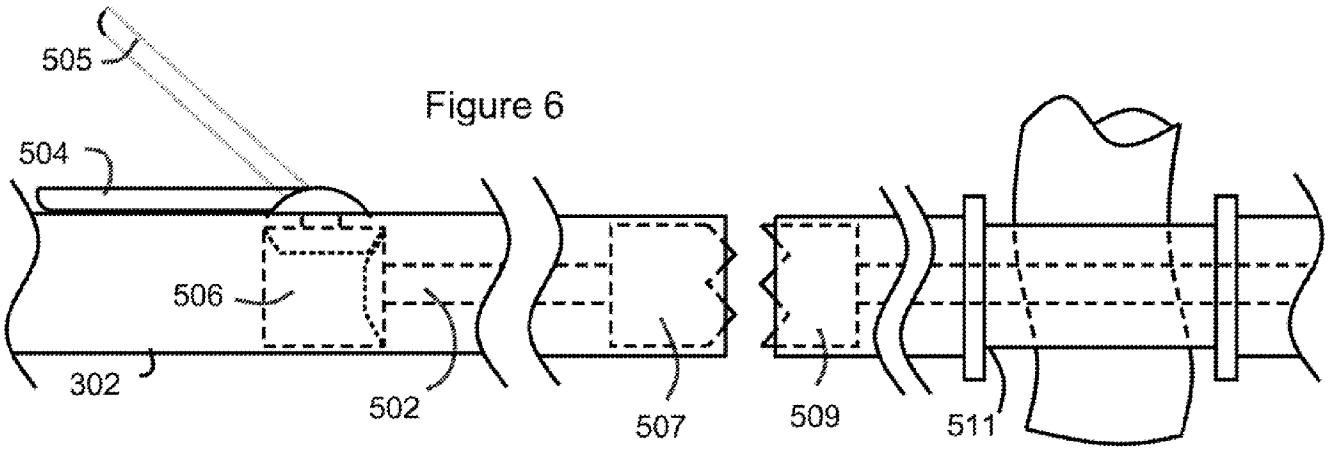
FIG. 6 is a side view of the internal ratchet shaft and ratcheting lever.
Figure 7:
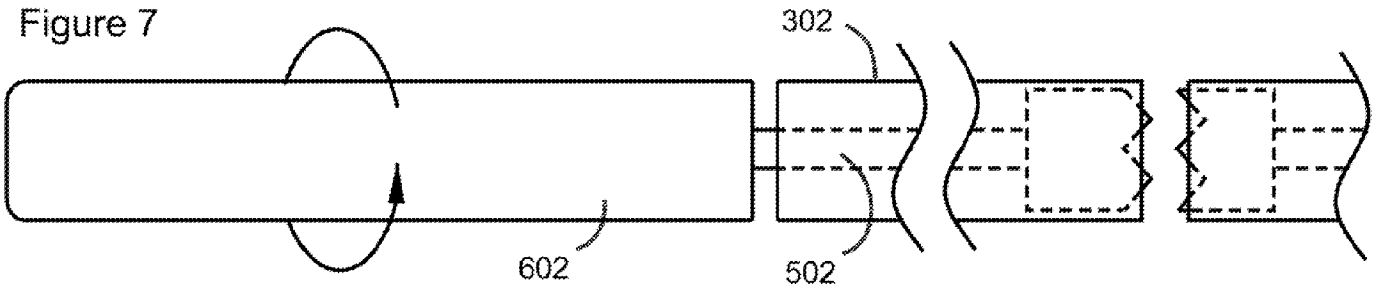
FIG. 7 is a side view of the internal ratchet shaft and handle lever.
Figure 9:
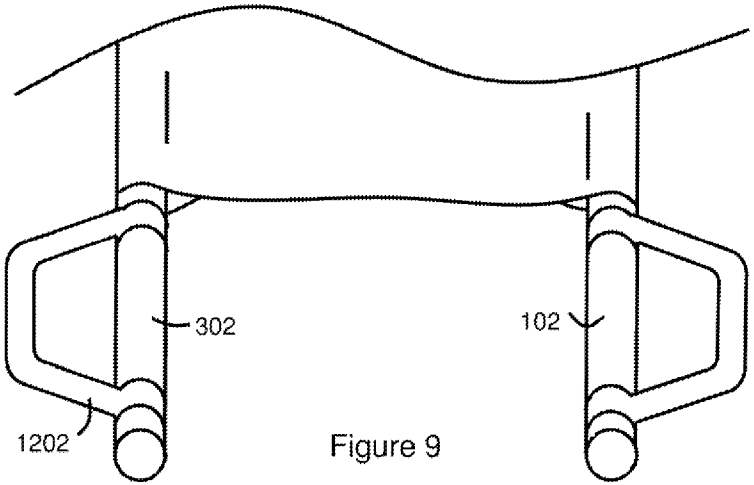
FIG. 9 is an isometric view of two handles mounted on frame arms.
Figure 8:
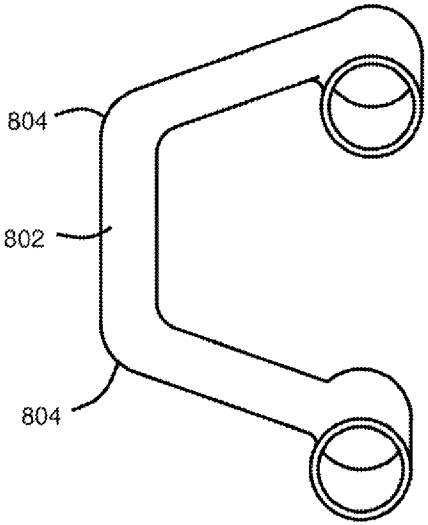
FIG. 8 is an isometric view of a handle.
Figure 10:
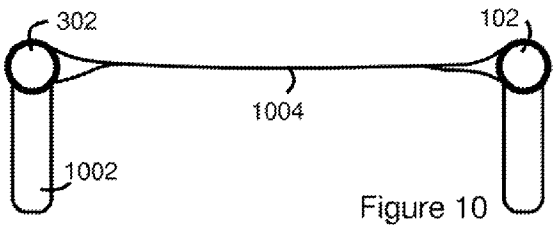
FIG. 10 is a front cutaway view of the handles as legs.
Figure 11:
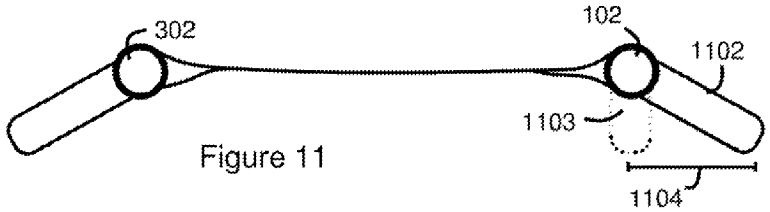
FIG. 11 is a front cutaway view of the handles as stabilizing legs.
Figure 12:
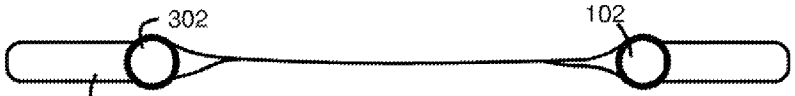
FIG. 12 is a front cutaway view of the handles as handles.
Figure 13:
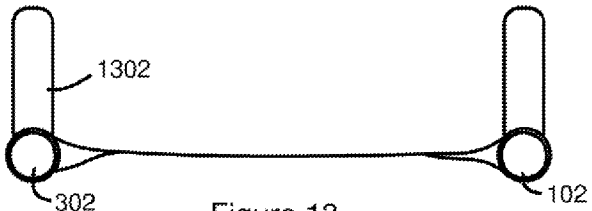
FIG. 13 is a front cutaway view of the handles as connectors for blankets or a helicopter.

Shown in FIG. 6, one or more ratchets 511 are connected by a ratchet shaft 502 that runs through the strap-receiving frame arm 302. At the end of the ratchet shaft 502 is a handle 504 that is used to turn the shaft 502. In FIG. 6, the shaft 502 is turned by raising the handle into an upright position 505 and lowering it into a lowered position 504. A variety of handles are possible, with an up/down handle as used by a standard ratchet strap being the most preferable. A turn-crank handle is another ideal example. In an alternate embodiment of FIG. 6, as shown by FIG. 7, the handle 602 is connected directly to the ratchet shaft, such that the section to be gripped when carrying the stretcher acts as the stretcher handle and ratchet handle which potentially eliminates the need for the changing gears 506 which redirect the handle movement to turn the shaft.

An additional benefit to this design over a traditional strap is that during a combat situation, the rescuer can tighten the straps while in a prone position, rather than having to stand over the body to adjust the straps. While in the prone position, the rescuer can tighten the straps without looking, and yet can never over-tighten the straps and injure the occupant. This makes the ratchet system potentially life-saving for the rescuer.

The ratchet system is designed to also be compatible with collapsible stretchers. In a collapsible stretcher the frame arms are made of several hinged shafts that lock together. Because there are multiple pieces, a single shaft 502 cannot be used. To solve this issue, at each break point in the strap-receiving frame arm 302 the shaft 502 ends in a toothed gear 507 and 509. While there are multiple forms of gears that can be used, in the preferred embodiment the gear teeth are in the same plane as the shaft opening, and the gears have angled teeth. This will allow the two gears 507 and 509 to connect together and automatically align when the frame arm is put together. This forms a single shaft that that will turn all ratchets in the stretcher at once. Springs within the frame arm pushing the gears 507 and 509 towards the frame opening can be used to create additional tension and further secure the shaft sections into a whole.

FIGS. 8 through 13 show the handle system. The handle 802 rotates around the arm shafts 302, 102 into multiple positions. The curved 804 shape of the handle is important of use when dragging to prevent the handle from getting caught on ground obstacles. For further dragging performance, one or more wheels can be added to the handle.

Figure 16:
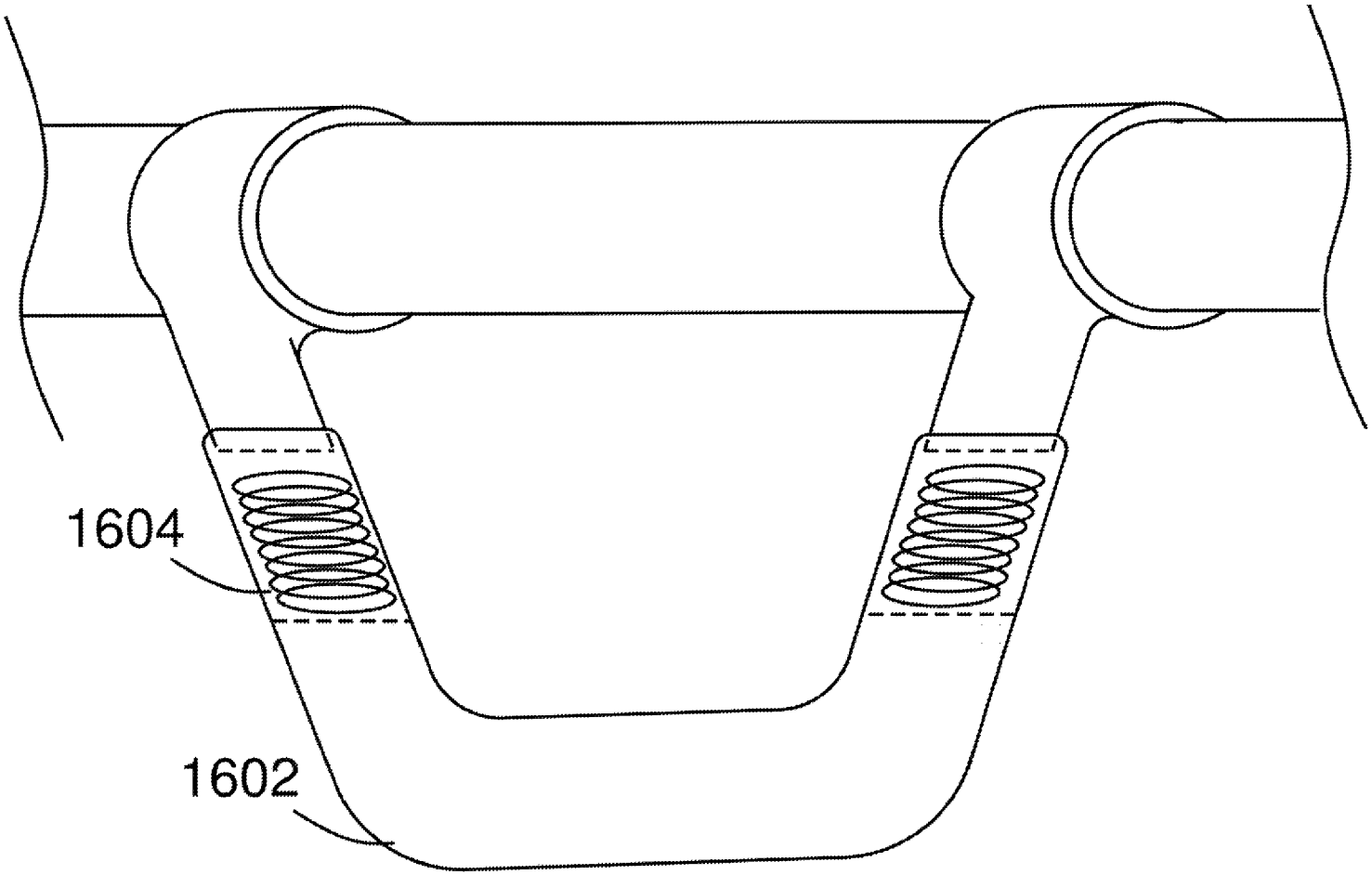
FIG. 16 is a side view of a handle with shock-absorbing springs.

Using the fabric body 1004 as a plane of reference, the handles 803 can be rotated into numerous positions. When the handle is at an approximately 270 degrees ("down") angle, it is a leg handle 1002 and the handles act as legs for the stretcher, raising it from the ground. It should be noted that the stretcher can have other, shorter permanent legs as well. When the handle greater than 180 degrees ("horizontal) and less than 270 degrees ("down") it is a stabilizing leg handle 1102. The purpose of the stabilizing leg handle 1102 is to create a wider base for the stretcher when it is being dragged along the ground. As shown in the figure, a vertical leg 1103 has a much narrower base 1104 than the extended leg 1102. This helps prevent the stretcher from flipping, and the rounded shape of the handle promotes easy dragging. If a stretcher is 2 foot wide, and has 6" legs 1102, by rotating the legs, we can add approximately 30-40% more width to the base over a traditional stretcher, dramatically improving stability. As shown in FIG. 16, if the stretcher is used for dragging, a handle 1602 can be fitted with springs 1604 to act as shock-absorbers.

Figure 14:
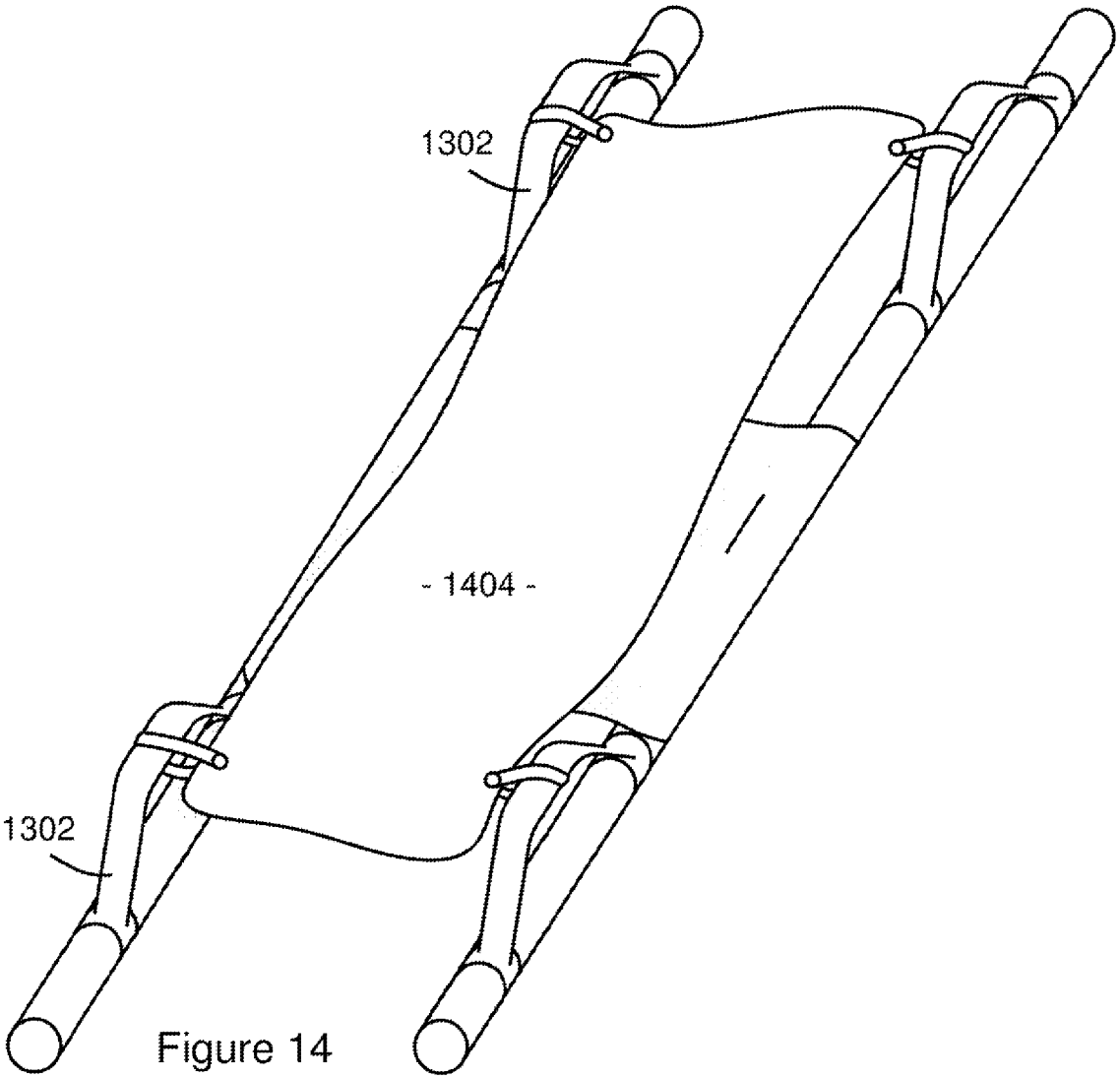
FIG. 14 is an isometric view of the stretcher with handles as connectors with a ballistic blanket.
Figure 15:
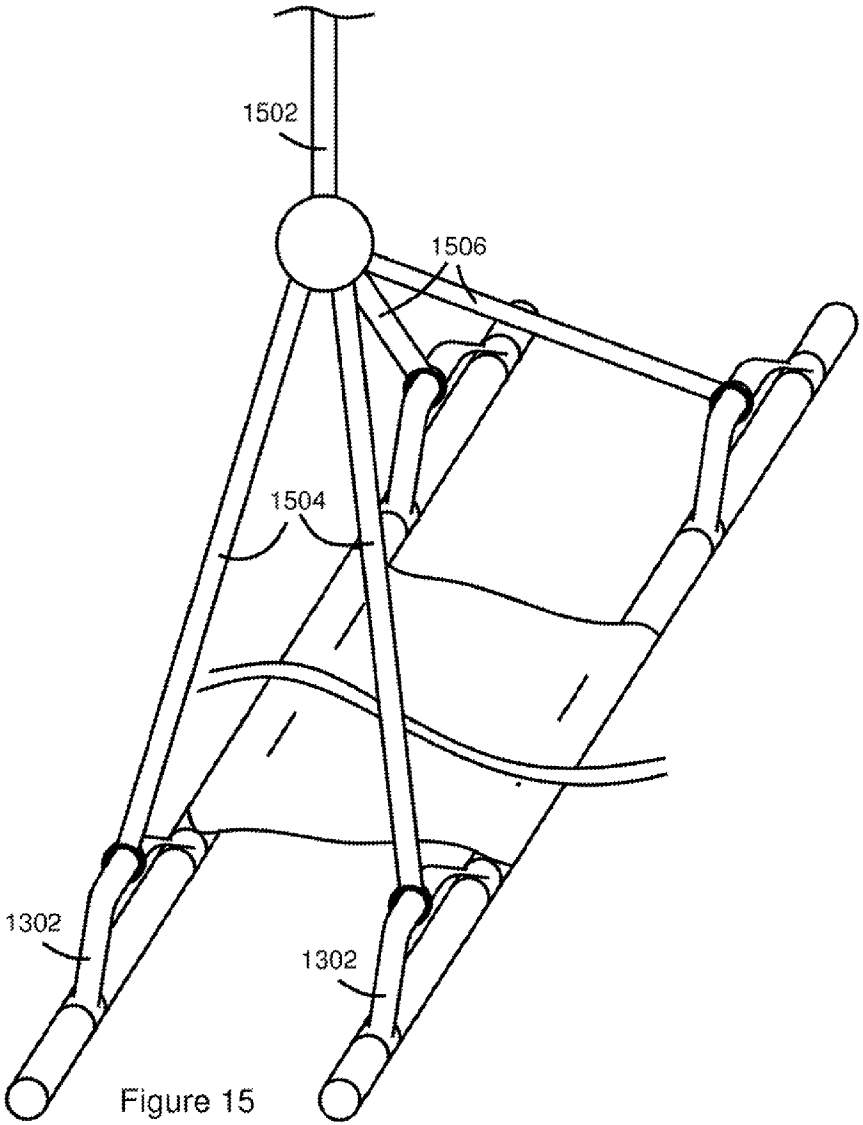
FIG. 15 is an isometric view of the stretchers with the handles as connectors for a helicopter.

When the handle is in an approximately 180 degree angle ("horizontal") it is a handle 1202 that provides an easy grip for carrying the stretcher. It should be noted that in all positions the handles can be used for carrying. They can be individually adjusted to provide a range of heights to keep the stretcher level when people of different heights are carrying the stretcher. They different handle positions can also be used when, for example, the stretcher needs to be dragged low to the ground such as in a military situation where the rescuer must remain under cover. With a traditional stretcher of this style, it would be difficult to get a grip on the handle, whereas here the handle would simply be put into a 180 degree or less position. When the handle is at 180 degrees or less, it acts as a connection handle 1302. As depicted in FIG. 14, thermal or ballistic blankets 1404 can be attached to the connection handle 1302 to cover the occupant and provide protection or comfort to the occupant. As shown in FIG. 15, a helicopter with a rescue cable 1502 can attach two straps 1504 (such that the stretcher is vertical) or four straps 1504 and 1406 (such that the stretcher is horizontal) connections to the connection handles 1302 for transportation.

It should be noted that while four handles would be the most common, two handles can be used, as can six or more. Also, each handle is independent of the other, such that the "rear" two legs could be in a wide position for dragging, and the "front" two legs in a horizontal position for easy grip by the rescuer(s).

The handle 803 is secured into the above positions via a locking mechanism. The locking mechanism can take many forms, but must be sturdy enough for use when all of the stretcher and occupant weight is being held by the handles and handle locks. It must also be quick to change the position of the handles. The locking mechanism must also not be such that it can accidently be released during transport of the stretcher.

Figure 17:
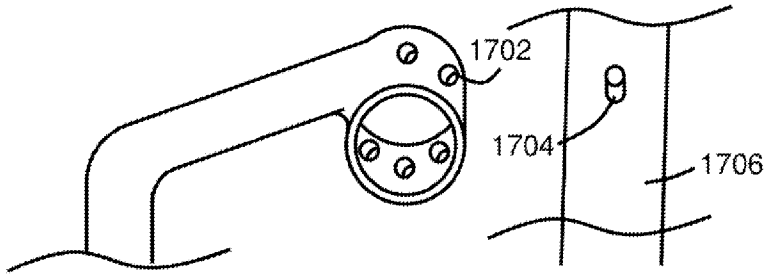
FIG. 17 is a top view of a handle and frame arm with connectors.
Figure 18:
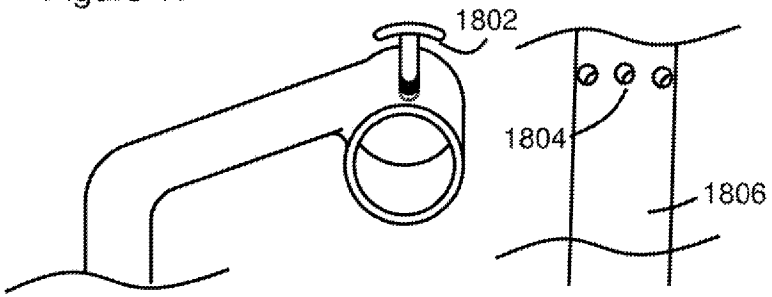
FIG. 18 is a top view of a handle and frame arm with connectors.
Figure 19:
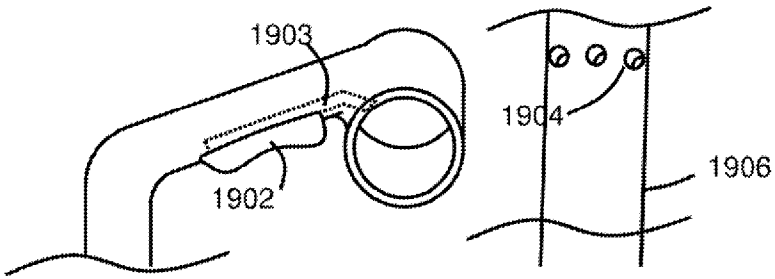
FIG. 19 is a top view of a handle and frame arm with connectors.

FIG. 17 shows a spring push button 1704 on the arm 1706 and receiving holes 1702 on the handle. FIG. 18 shows holes 1804 in the arm 1806 and a spring-loaded locking bar 1802. FIG. 19 shows an arm 1906 with holes 1904 with a handle having a grip-button 1902 that activates a spring-connected rod 1903 that connects to the holes 1904.

While the above systems use springs and buttons with holes to connect, other systems are potentially viable. Tension can be used to attach the handle to the arm, for example with a system similar to a pipe clamp where the tightening screw is tightenable by hand with no tools.

What is claimed is:

1. A litter comprising:

a first arm shaft having a first and a second end, said first arm shaft being a lock receiving frame arm having a first locking means, a locking shaft having a first and a second end, said locking shaft being a lock arm having a second locking means, said second locking means interacting with said first locking means to releasably retain said first arm shaft adjacent to second arm shaft and least one strap retaining means, said at least one strap retaining means being separate from adjacent at least one strap retaining means;

at least one strap, each of said at least one strap interacting with said at least one strap retaining means;

said second arm shaft having a first and a second end, said second arm shaft having a strap receiving frame arm said stop receiving frame arm of having at least one ratchet, each of said at least one at ratchet been dimensioned to receive said strap.

2. The litter of claim 1 further comprising at least one torque limiter, each of said torque limiter preventing said at least one strap from being tightened beyond a preset tension point.

3. The litter of claimed 1 further comprising a ratchet shaft, said ratchet shaft being within said second arm shaft and in rotatable connection with each of said at least one ratchet.

4. The litter of claimed 3 further comprising a handle said handle rotating said ratchet shaft.

5. The litter of claim 1 for the comprising at least one handle each of said at least one handle having two rotation points spaced from one another, said two rotation points being rotatable around said first and said second end of said first arm shaft and said second on shaft.

6. The litter of claim 5 wherein said handles rotate to serve as legs.

7. The litter of claim 5 further comprising locking means for each of said at least one handle.

* * * * *